US009583110B2

(12) United States Patent
Fuchs et al.

(10) Patent No.: US 9,583,110 B2
(45) Date of Patent: Feb. 28, 2017

(54) APPARATUS AND METHOD FOR PROCESSING A DECODED AUDIO SIGNAL IN A SPECTRAL DOMAIN

(71) Applicant: Fraunhofer-Gesellschaft zur Foerderung der angewandten Forschung e.V., Munich (DE)

(72) Inventors: Guillaume Fuchs, Erlangen (DE); Ralf Geiger, Erlangen (DE); Markus Schnell, Nuremberg (DE); Emmanuel Ravelli, Erlangen (DE); Stefan Doehla, Erlangen (DE)

(73) Assignee: Fraunhofer-Gesellschaft zur Foerderung der angewandten Forschung e.V., Munich (DE)

( * ) Notice: Subject to any disclaimer, the term of this patent is extended or adjusted under 35 U.S.C. 154(b) by 541 days.

(21) Appl. No.: 13/966,570

(22) Filed: Aug. 14, 2013

(65) Prior Publication Data

US 2013/0332151 A1 Dec. 12, 2013

Related U.S. Application Data

(63) Continuation of application No. PCT/EP2012/052292, filed on Feb. 10, 2012.
(Continued)

(51) Int. Cl.
*G10L 19/00* (2013.01)
*G10L 19/012* (2013.01)
(Continued)

(52) U.S. Cl.
CPC ..... *G10L 19/00* (2013.01); *G10K 11/16* (2013.01); *G10L 19/005* (2013.01);
(Continued)

(58) Field of Classification Search
CPC ..... G10L 19/12; G10L 19/26
See application file for complete search history.

(56) References Cited

U.S. PATENT DOCUMENTS 5,537,510 A 7/1996 Kim
5,598,506 A 1/1997 Wigren et al.
(Continued)

FOREIGN PATENT DOCUMENTS

AU 2007/312667 4/2008
CA 2730239 A1 1/2010
(Continued)

OTHER PUBLICATIONS

"Digital Cellular Telecommunications System (Phase 2+); Universal Mobile Telecommunications System (UMTS); LTE; Speech codec speech processing functions; Adaptive Multi-Rate-Wideband (AMR-)WB Speech Codec; Transcoding Functions (3GPP TS 26.190 version 9.0.0", Technical Specification, European Telecommunications Standards Institute (ETSI) 650, Route Des Lucioles; F-06921 Sophia-Antipolis; France; No. V.9.0.0, Jan. 1, 2012, 54 Pages.
(Continued)

*Primary Examiner* — Samuel G Neway
(74) *Attorney, Agent, or Firm* — Michael A. Glenn; Perkins Coie LLP

(57) ABSTRACT

An apparatus for processing a decoded audio signal including a filter for filtering the decoded audio signal to obtain a filtered audio signal, a time-spectral converter stage for converting the decoded audio signal and the filtered audio signal into corresponding spectral representations, each spectral representation having a plurality of subband signals, a weighter for performing a frequency selective weighting of the filtered audio signal by a multiplying subband signals by respective weighting coefficients to obtain a weighted filtered audio signal, a subtractor for performing a subband-
(Continued)

wise subtraction between the weighted filtered audio signal and the spectral representation of the decoded audio signal, and a spectral-time converter for converting the result audio signal or a signal derived from the result audio signal into a time domain representation to obtain a processed decoded audio signal.

16 Claims, 10 Drawing Sheets

Related U.S. Application Data

(60) Provisional application No. 61/442,632, filed on Feb. 14, 2011.

(51) Int. Cl.

| | |
|---|---|
| ***G10K 11/16*** | (2006.01) |
| ***G10L 19/005*** | (2013.01) |
| ***G10L 19/12*** | (2013.01) |
| ***G10L 19/03*** | (2013.01) |
| ***G10L 19/22*** | (2013.01) |
| ***G10L 21/0216*** | (2013.01) |
| ***G10L 25/78*** | (2013.01) |
| *G10L 19/26* | (2013.01) |
| *G10L 19/04* | (2013.01) |
| *G10L 19/02* | (2013.01) |
| *G10L 25/06* | (2013.01) |
| *G10L 19/025* | (2013.01) |
| *G10L 19/107* | (2013.01) |

(52) U.S. Cl.

CPC ..... *G10L 19/012* (2013.01); *G10L 19/03* (2013.01); *G10L 19/12* (2013.01); *G10L 19/22* (2013.01); *G10L 21/0216* (2013.01); *G10L 25/78* (2013.01); *G10L 19/025* (2013.01); *G10L 19/0212* (2013.01); *G10L 19/04* (2013.01); *G10L 19/107* (2013.01); *G10L 19/26* (2013.01); *G10L 25/06* (2013.01)

(56) References Cited

U.S. PATENT DOCUMENTS

| | | | |
|---|---|---|---|
| 5,606,642 | A | 2/1997 | Stautner et al. |
| 5,684,920 | A | 11/1997 | Iwakami et al. |
| 5,727,119 | A | 3/1998 | Davidson et al. |
| 5,848,391 | A | 12/1998 | Bosi et al. |
| 5,890,106 | A | 3/1999 | Bosi-Goldberg et al. |
| 5,953,698 | A | 9/1999 | Hayata |
| 5,960,389 | A | 9/1999 | Jarvinen et al. |
| 6,070,137 | A | 5/2000 | Bloebaum et al. |
| 6,134,518 | A | 10/2000 | Cohen et al. |
| 6,173,257 | B1 | 1/2001 | Gao |
| 6,236,960 | B1 | 5/2001 | Peng et al. |
| 6,317,117 | B1 | 11/2001 | Goff |
| 6,532,443 | B1 | 3/2003 | Nishiguchi et al. |
| 6,587,817 | B1 | 7/2003 | Vähätalo et al. |
| 6,636,829 | B1 | 10/2003 | Benyassine et al. |
| 6,636,830 | B1 | 10/2003 | Princen et al. |
| 6,680,972 | B1 | 1/2004 | Liljeryd et al. |
| 6,757,654 | B1 | 6/2004 | Westerlund et al. |
| 6,879,955 | B2 | 4/2005 | Rao et al. |
| 6,969,309 | B2 | 11/2005 | Carpenter |
| 6,980,143 | B2 | 12/2005 | Linzmeier et al. |
| 7,003,448 | B1 | 2/2006 | Lauber et al. |
| 7,124,079 | B1 | 10/2006 | Johansson et al. |
| 7,249,014 | B2 | 7/2007 | Kannan et al. |
| 7,280,959 | B2 | 10/2007 | Bessette |
| 7,343,283 | B2 | 3/2008 | Ashley et al. |
| 7,363,218 | B2 | 4/2008 | Jabri et al. |
| 7,519,535 | B2 | 4/2009 | Spindola |
| 7,519,538 | B2 | 4/2009 | Villemoes et al. |
| 7,536,299 | B2 | 5/2009 | Cheng et al. |
| 7,565,286 | B2 | 7/2009 | Gracie et al. |
| 7,587,312 | B2 | 9/2009 | Kim |
| 7,627,469 | B2 | 12/2009 | Nettre et al. |
| 7,707,034 | B2 | 4/2010 | Sun et al. |
| 7,711,563 | B2 | 5/2010 | Chen |
| 7,788,105 | B2 | 8/2010 | Miseki |
| 7,801,735 | B2 | 9/2010 | Thumpudi et al. |
| 7,809,556 | B2 | 10/2010 | Goto et al. |
| 7,860,720 | B2 | 12/2010 | Thumpudi et al. |
| 7,873,511 | B2 | 1/2011 | Herre et al. |
| 7,877,253 | B2 | 1/2011 | Krishnan et al. |
| 7,917,369 | B2 | 3/2011 | Chen et al. |
| 7,930,171 | B2 | 4/2011 | Lee et al. |
| 7,933,769 | B2 | 4/2011 | Bessette |
| 7,979,271 | B2 | 7/2011 | Bessette |
| 7,987,089 | B2 | 7/2011 | Krishnan et al. |
| 8,045,572 | B1 | 10/2011 | Li et al. |
| 8,078,458 | B2 | 12/2011 | Zopf et al. |
| 8,121,831 | B2 | 2/2012 | Oh et al. |
| 8,160,274 | B2 | 4/2012 | Bongiovi |
| 8,239,192 | B2 | 8/2012 | Kovesi et al. |
| 8,255,207 | B2 | 8/2012 | Vaillancourt et al. |
| 8,255,213 | B2 | 8/2012 | Yoshida et al. |
| 8,363,960 | B2 | 1/2013 | Petersohn |
| 8,364,472 | B2 | 1/2013 | Ehara |
| 8,428,936 | B2 | 4/2013 | Mittal et al. |
| 8,428,941 | B2 | 4/2013 | Boehm et al. |
| 8,452,884 | B2 | 5/2013 | Wang |
| 8,566,106 | B2 | 10/2013 | Salami et al. |
| 8,630,862 | B2 | 1/2014 | Geiger et al. |
| 8,630,863 | B2 | 1/2014 | Son et al. |
| 8,635,357 | B2 | 1/2014 | Ebersviller |
| 8,825,496 | B2 | 9/2014 | Setiawan et al. |
| 8,954,321 | B1 | 2/2015 | Beack et al. |
| 2002/0111799 | A1 | 8/2002 | Bernard |
| 2002/0176353 | A1 | 11/2002 | Atlas et al. |
| 2002/0184009 | A1 | 12/2002 | Heikkinen |
| 2003/0009325 | A1 | 1/2003 | Kirchherr et al. |
| 2003/0033136 | A1 | 2/2003 | Lee |
| 2003/0046067 | A1 | 3/2003 | Gradl |
| 2003/0078771 | A1 | 4/2003 | Jung et al. |
| 2003/0225576 | A1 | 12/2003 | Li et al. |
| 2004/0010329 | A1 | 1/2004 | Lee et al. |
| 2004/0093204 | A1 | 5/2004 | Byun et al. |
| 2004/0093368 | A1 | 5/2004 | Lee et al. |
| 2004/0184537 | A1 | 9/2004 | Geiger et al. |
| 2004/0193410 | A1 | 9/2004 | Lee et al. |
| 2004/0220805 | A1 | 11/2004 | Geiger et al. |
| 2004/0225505 | A1 | 11/2004 | Andersen et al. |
| 2005/0021338 | A1 | 1/2005 | Graboi et al. |
| 2005/0065785 | A1 | 3/2005 | Bessette |
| 2005/0080617 | A1 | 4/2005 | Koshy et al. |
| 2005/0091044 | A1 | 4/2005 | Ramo et al. |
| 2005/0096901 | A1 | 5/2005 | Uvliden et al. |
| 2005/0130321 | A1 | 6/2005 | Nicholson et al. |
| 2005/0131696 | A1 | 6/2005 | Wang et al. |
| 2005/0154584 | A1 | 7/2005 | Jelinek et al. |
| 2005/0165603 | A1* | 7/2005 | Bessette ..... G10L 21/0364 704/200.1 |
| 2005/0192798 | A1 | 9/2005 | Vainio et al. |
| 2005/0240399 | A1 | 10/2005 | Makinen |
| 2005/0278171 | A1 | 12/2005 | Suppappola et al. |
| 2006/0095253 | A1 | 5/2006 | Schuller et al. |
| 2006/0115171 | A1 | 6/2006 | Geiger et al. |
| 2006/0116872 | A1 | 6/2006 | Byun et al. |
| 2006/0173675 | A1 | 8/2006 | Ojanpera et al. |
| 2006/0206334 | A1 | 9/2006 | Kapoor et al. |
| 2006/0210180 | A1 | 9/2006 | Geiger et al. |
| 2006/0271356 | A1 | 11/2006 | Vos |
| 2006/0293885 | A1 | 12/2006 | Gournay et al. |
| 2007/0016404 | A1 | 1/2007 | Kim et al. |
| 2007/0050189 | A1 | 3/2007 | Cruz-Zeno et al. |
| 2007/0100607 | A1 | 5/2007 | Villemoes et al. |
| 2007/0147518 | A1 | 6/2007 | Bessette |
| 2007/0160218 | A1* | 7/2007 | Jakka ..... H04S 3/004 381/22 |
| 2007/0171931 | A1 | 7/2007 | Manjunath et al. |

(56) References Cited

U.S. PATENT DOCUMENTS

| | | | | |
|---|---|---|---|---|
| 2007/0174047 | A1 | 7/2007 | Anderson et al. | |
| 2007/0196022 | A1 | 8/2007 | Geiger et al. | |
| 2007/0225971 | A1 | 9/2007 | Bessette | |
| 2007/0253577 | A1 | 11/2007 | Yen et al. | |
| 2007/0282603 | A1 | 12/2007 | Bessette | |
| 2008/0010064 | A1 | 1/2008 | Takeuchi et al. | |
| 2008/0015852 | A1 | 1/2008 | Kruger et al. | |
| 2008/0027719 | A1 | 1/2008 | Kirshnan et al. | |
| 2008/0046236 | A1 | 2/2008 | Thyssen et al. | |
| 2008/0052068 | A1 | 2/2008 | Aguilar et al. | |
| 2008/0097764 | A1 | 4/2008 | Grill et al. | |
| 2008/0120116 | A1 | 5/2008 | Schnell et al. | |
| 2008/0147415 | A1 | 6/2008 | Schnell et al. | |
| 2008/0208599 | A1 | 8/2008 | Rosec et al. | |
| 2008/0221905 | A1 | 9/2008 | Schnell et al. | |
| 2008/0249765 | A1 | 10/2008 | Schuijers et al. | |
| 2008/0275580 | A1 | 11/2008 | Andersen | |
| 2009/0024397 | A1 | 1/2009 | Ryu et al. | |
| 2009/0076807 | A1 | 3/2009 | Xu et al. | |
| 2009/0110208 | A1* | 4/2009 | Choo | G10L 25/93 381/71.1 |
| 2009/0204412 | A1 | 8/2009 | Kovesi et al. | |
| 2009/0226016 | A1 | 9/2009 | Fitz et al. | |
| 2009/0228285 | A1 | 9/2009 | Schnell et al. | |
| 2009/0319283 | A1* | 12/2009 | Schnell | G10L 19/0204 704/503 |
| 2009/0326930 | A1 | 12/2009 | Kawashima et al. | |
| 2009/0326931 | A1 | 12/2009 | Ragot et al. | |
| 2010/0017200 | A1 | 1/2010 | Oshikiri et al. | |
| 2010/0017213 | A1 | 1/2010 | Edler et al. | |
| 2010/0049511 | A1 | 2/2010 | Ma et al. | |
| 2010/0063811 | A1 | 3/2010 | Gao et al. | |
| 2010/0063812 | A1 | 3/2010 | Gao et al. | |
| 2010/0070270 | A1 | 3/2010 | Gao | |
| 2010/0106496 | A1 | 4/2010 | Morii et al. | |
| 2010/0138218 | A1 | 6/2010 | Geiger | |
| 2010/0198586 | A1 | 8/2010 | Edler et al. | |
| 2010/0217607 | A1 | 8/2010 | Neuendorf et al. | |
| 2010/0262420 | A1 | 10/2010 | Herre et al. | |
| 2010/0268542 | A1 | 10/2010 | Kim et al. | |
| 2011/0002393 | A1 | 1/2011 | Suzuki et al. | |
| 2011/0007827 | A1 | 1/2011 | Virette et al. | |
| 2011/0106542 | A1 | 5/2011 | Bayer et al. | |
| 2011/0153333 | A1 | 6/2011 | Bessette et al. | |
| 2011/0161088 | A1 | 6/2011 | Bayer et al. | |
| 2011/0173010 | A1 | 7/2011 | Lecomte et al. | |
| 2011/0173011 | A1 | 7/2011 | Geiger et al. | |
| 2011/0178795 | A1 | 7/2011 | Bayer et al. | |
| 2011/0218797 | A1 | 9/2011 | Mittal et al. | |
| 2011/0218799 | A1 | 9/2011 | Mittal et al. | |
| 2011/0218801 | A1 | 9/2011 | Vary et al. | |
| 2011/0257979 | A1* | 10/2011 | Gao | G10L 19/26 704/500 |
| 2011/0270616 | A1 | 11/2011 | Garudadri et al. | |
| 2011/0311058 | A1 | 12/2011 | Oh et al. | |
| 2012/0022881 | A1 | 1/2012 | Geiger et al. | |
| 2012/0226505 | A1 | 9/2012 | Lin et al. | |
| 2012/0271644 | A1* | 10/2012 | Bessette | G10L 19/03 704/500 |
| 2013/0332151 | A1* | 12/2013 | Fuchs | G10L 19/012 704/207 |
| 2014/0257824 | A1 | 9/2014 | Taleb et al. | |

FOREIGN PATENT DOCUMENTS

| | | | |
|---|---|---|---|
| CN | 1274456 | A | 11/2000 |
| CN | 1344067 | A | 4/2002 |
| CN | 1381956 | A | 11/2002 |
| CN | 1437747 | A | 8/2003 |
| CN | 1539137 | A | 10/2004 |
| CN | 1539138 | A | 10/2004 |
| CN | 101351840 | | 10/2006 |
| CN | 101110214 | A | 1/2008 |
| CN | 101366077 | A | 2/2009 |
| CN | 101371295 | A | 2/2009 |
| CN | 101379551 | A | 3/2009 |
| CN | 101388210 | A | 3/2009 |
| CN | 101425292 | A | 5/2009 |
| CN | 101483043 | A | 7/2009 |
| CN | 101488344 | A | 7/2009 |
| CN | 101743587 | | 6/2010 |
| CN | 101770775 | A | 7/2010 |
| DE | 102008015702 | A1 | 8/2009 |
| EP | 0665530 | A1 | 8/1995 |
| EP | 0673566 | A1 | 9/1995 |
| EP | 0758123 | A2 | 2/1997 |
| EP | 0784846 | A1 | 7/1997 |
| EP | 0843301 | B1 | 5/1998 |
| EP | 1120775 | A1 | 8/2001 |
| EP | 1852851 | | 7/2007 |
| EP | 1845520 | A1 | 10/2007 |
| EP | 2107556 | | 7/2009 |
| EP | 2109098 | A2 | 10/2009 |
| EP | 2144230 | A1 | 1/2010 |
| FR | 2911228 | A1 | 7/2008 |
| FR | 2929466 | A1 | 10/2009 |
| JP | H08263098 | A | 10/1996 |
| JP | 10039898 | A | 2/1998 |
| JP | H10214100 | A | 8/1998 |
| JP | H11502318 | A | 2/1999 |
| JP | H1198090 | A | 4/1999 |
| JP | 2000357000 | A | 12/2000 |
| JP | 2002-118517 | | 4/2002 |
| JP | 2003501925 | A | 1/2003 |
| JP | 2003506764 | A | 2/2003 |
| JP | 2004513381 | A | 4/2004 |
| JP | 2004514182 | A | 5/2004 |
| JP | 2005534950 | A | 11/2005 |
| JP | 2006504123 | A | 2/2006 |
| JP | 2007065636 | A | 3/2007 |
| JP | 2007523388 | A | 8/2007 |
| JP | 2007525707 | A | 9/2007 |
| JP | 2007538282 | A | 12/2007 |
| JP | 2008-15281 | | 1/2008 |
| JP | 2008513822 | A | 5/2008 |
| JP | 2008261904 | A | 10/2008 |
| JP | 2009508146 | A | 2/2009 |
| JP | 2009075536 | A | 4/2009 |
| JP | 2009522588 | A | 6/2009 |
| JP | 2009-527773 | | 7/2009 |
| JP | 2010530084 | A | 9/2010 |
| JP | 2010-538314 | | 12/2010 |
| JP | 2010539528 | A | 12/2010 |
| JP | 2011501511 | A | 1/2011 |
| JP | 2011527444 | A | 10/2011 |
| KR | 1020040043278 | A | 5/2004 |
| KR | 1020060025203 | A | 3/2006 |
| KR | 1020070088276 | A | 8/2007 |
| KR | 20080032160 | A | 4/2008 |
| KR | 1020100059726 | A | 6/2010 |
| RU | 2169992 | C2 | 6/2001 |
| RU | 2183034 | C2 | 5/2002 |
| RU | 2003118444 | A | 12/2004 |
| RU | 2004138289 | A | 6/2005 |
| RU | 2296377 | C2 | 3/2007 |
| RU | 2302665 | C2 | 7/2007 |
| RU | 2312405 | C2 | 12/2007 |
| RU | 2331933 | C2 | 8/2008 |
| RU | 2335809 | C2 | 10/2008 |
| RU | 2008126699 | A | 2/2010 |
| RU | 2009107161 | A | 9/2010 |
| RU | 2009118384 | A | 11/2010 |
| TW | 200830277 | | 10/1996 |
| TW | 200943279 | | 10/1998 |
| TW | 201032218 | | 9/1999 |
| TW | 380246 | B | 1/2000 |
| TW | 469423 | B | 12/2001 |
| TW | I253057 | B | 4/2006 |
| TW | 200703234 | A | 1/2007 |
| TW | 200729156 | A | 8/2007 |
| TW | 200841743 | A | 10/2008 |
| TW | I313856 | B | 8/2009 |
| TW | 200943792 | A | 10/2009 |

(56) References Cited

FOREIGN PATENT DOCUMENTS

| | | | | |
|---|---|---|---|---|
| TW | I316225 | B | 10/2009 | |
| TW | I 320172 | | 2/2010 | |
| TW | 201009810 | A | 3/2010 | |
| TW | 201009812 | A | 3/2010 | |
| TW | I324762 | B | 5/2010 | |
| TW | 201027517 | A | 7/2010 | |
| TW | 201030735 | A | 8/2010 | |
| TW | 201040943 | | 11/2010 | |
| TW | I333643 | B | 11/2010 | |
| TW | 201103009 | | 1/2011 | |
| WO | 92/22891 | A1 | 12/1992 | |
| WO | 95/10890 | A1 | 4/1995 | |
| WO | 95/30222 | A1 | 11/1995 | |
| WO | 96/29696 | A1 | 9/1996 | |
| WO | 00/31719 | A2 | 6/2000 | |
| WO | 0075919 | A1 | 12/2000 | |
| WO | 02/101724 | A1 | 12/2002 | |
| WO | WO-02101722 | | 12/2002 | |
| WO | 2004027368 | A1 | 4/2004 | |
| WO | 2005041169 | A2 | 5/2005 | |
| WO | 2005078706 | A1 | 8/2005 | |
| WO | 2005081231 | A1 | 9/2005 | |
| WO | 2005112003 | A1 | 11/2005 | |
| WO | 2006082636 | A1 | 8/2006 | |
| WO | 2006126844 | A2 | 11/2006 | |
| WO | WO-2007051548 | | 5/2007 | |
| WO | 2007083931 | A1 | 7/2007 | |
| WO | WO-2007073604 | | 7/2007 | |
| WO | WO2007/096552 | | 8/2007 | |
| WO | WO-2008013788 | | 10/2008 | |
| WO | 2008/157296 | A1 | 12/2008 | |
| WO | WO-2009029032 | | 3/2009 | |
| WO | 2009/121499 | A1 | 10/2009 | |
| WO | 2009077321 | A3 | 10/2009 | |
| WO | 2010/003563 | A1 | 1/2010 | |
| WO | 2010003491 | A1 | 1/2010 | |
| WO | WO-2010/003491 | | 1/2010 | |
| WO | WO-2010003532 | | 1/2010 | |
| WO | WO-2010040522 | | 4/2010 | |
| WO | 2010059374 | A1 | 5/2010 | |
| WO | 2010/081892 | A2 | 7/2010 | |
| WO | 2010093224 | A2 | 8/2010 | |
| WO | 2011/006369 | A1 | 1/2011 | |
| WO | WO-2011048094 | | 4/2011 | |
| WO | WO 2011048117 | A1 * | 4/2011 | ..... G10L 19/03 |
| WO | 2011/147950 | A1 | 12/2011 | |

OTHER PUBLICATIONS

"IEEE Signal Processing Letters", IEEE Signal Processing Society. vol. 15. ISSN 1070-9908., 2008, 9 Pages.

"Information Technology—MPEG Audio Technologies—Part 3: Unified Speech and Audio Coding", ISO/IEC JTC 1/SC 29 ISO/IEC DIS 23003-3, Feb. 9, 2011, 233 Pages.

"WD7 of USAC", International Organisation for Standardisation Organisation Internationale De Normailisation. ISO/IEC JTC1/SC29/WG11. Coding of Moving Pictures and Audio. Dresden, Germany., Apr. 2010, 148 Pages.

3GPP, , "3rd Generation Partnership Project; Technical Specification Group Service and System Aspects. Audio Codec Processing Functions. Extended AMR Wideband Codec; Transcoding functions (Release 6).", 3GPP Draft; 26.290, V2.0.0 3rd Generation Partnership Project (3GPP), Mobile Competence Centre; Valbonne, France., Sep. 2004, pp. 1-85.

Ashley, J et al., "Wideband Coding of Speech Using a Scalable Pulse Codebook", 2000 IEEE Speech Coding Proceedings., Sep. 17, 2000, pp. 148-150.

Bessette, B et al., "The Adaptive Multirate Wideband Speech Codec (AMR-WB)", IEEE Transactions on Speech and Audio Processing, IEEE Service Center. New York. vol. 10, No. 8., Nov. 1, 2002, pp. 620-636.

Bessette, B et al., "Universal Speech/Audio Coding Using Hybrid ACELP/TCX Techniques", ICASSP 2005 Proceedings. IEEE International Conference on Acoustics, Speech, and Signal Processing, vol. 3,, Jan. 2005, pp. 301-304.

Bessette, B et al., "Wideband Speech and Audio Codec at 16/24/32 Kbit/S Using Hybrid ACELP/TCX Techniques", 1999 IEEE Speech Coding Proceedings. Porvoo, Finland., Jun. 20, 1999, pp. 7-9.

Ferreira, A et al., "Combined Spectral Envelope Normalization and Subtraction of Sinusoidal Components in the ODFTand MDCT Frequency Domains", 2001 IEEE Workshop on Applications of Signal Processing to Audio and Acoustics., Oct. 2001, pp. 51-54.

Fischer, et al., "Enumeration Encoding and Decoding Algorithms for Pyramid Cubic Lattice and Trellis Codes", IEEE Transactions on Information Theory. IEEE Press, USA, vol. 41, No. 6, Part 2., Nov. 1, 1995, pp. 2056-2061.

Hermansky, H et al., "Perceptual linear predictive (PLP) analysis of speech", J. Acoust. Soc. Amer. 87 (4)., Apr. 1990, pp. 1738-1751.

Hofbauer, K et al., "Estimating Frequency and Amplitude of Sinusoids in Harmonic Signals—A Survey and the Use of Shifted Fourier Transforms", Graz: Graz University of Technology; Graz University of Music and Dramatic Arts; Diploma Thesis, Apr. 2004, 111 pages.

Lanciani, C et al., "Subband-Domain Filtering of MPEG Audio Signals", 1999 IEEE International Conference on Acoustics, Speech, and Signal Processing. Phoenix AZ, USA., Mar. 15, 1999, pp. 917-920.

Lauber, P et al., "Error Concealment for Compressed Digital Audio", Presented at the 111th AES Convention. Paper 5460. New York, USA., Sep. 21, 2001, 12 Pages.

Lee, Ick Don et al., "A Voice Activity Detection Algorithm for Communication Systems with Dynamically Varying Background Acoustic Noise", Dept. of Electrical Engineering, 1998 IEEE, May 18-21, 1998, pp. 1214-1218.

Makinen, J et al., "AMR-WB+: a New Audio Coding Standard for 3rd Generation Mobile Audio Services", 2005 IEEE International Conference on Acoustics, Speech, and Signal Processing. Philadelphia, PA, USA., Mar. 18, 2005, 1109-1112.

Motlicek, P et al., "Audio Coding Based on Long Temporal Contexts", Rapport de recherche de l'IDIAP 06-30, Apr. 2006, pp. 1-10.

Neuendorf, M et al., "A Novel Scheme for Low Bitrate Unified Speech Audio Coding—MPEG RMO", AES 126th Convention. Convention Paper 7713. Munich, Germany, May 1, 2009, 13 Pages.

Neuendorf, M et al., "Completion of Core Experiment on unification of USAC Windowing and Frame Transitions", International Organisation for Standardisation Organisation Internationale De Normalisation ISO/IEC JTC1/SC29/WG11. Coding of Moving Pictures and Audio. Kyoto, Japan., Jan. 2010, 52 Pages.

Neuendorf, M et al., "Unified Speech and Audio Coding Scheme for High Quality at Low Bitrates", ICASSP 2009 IEEE International Conference on Acoustics, Speech and Signal Processing. Piscataway, NJ, USA., Apr. 19, 2009, 4 Pages.

Patwardhan, P et al., "Effect of Voice Quality on Frequency-Warped Modeling of Vowel Spectra", Speech Communication. vol. 48, No. 8., Aug. 2006, pp. 1009-1023.

Ryan, D et al., "Reflected Simplex Codebooks for Limited Feedback MIMO Beamforming", IEEE. XP31506379A., Jun. 14-18, 2009, 6 Pages.

Sjoberg, J et al., "RTP Payload Format for the Extended Adaptive Multi-Rate Wideband (AMR-WB+) Audio Codec", Memo. The Internet Society. Network Working Group. Category: Standards Track., Jan. 2006, pp. 1-38.

Terriberry, T et al., "A Multiply-Free Enumeration of Combinations with Replacement and Sign", IEEE Signal Processing Letters. vol. 15, 2008, 11 Pages.

Terriberry, T et al., "Pulse Vector Coding", Retrieved from the internet on Oct. 12, 2012. XP55025946. URL:http://people.xiph.org/~tterribe/notes/cwrs.html, Dec. 1, 2007, 4 Pages.

Virette, D et al., "Enhanced Pulse Indexing CE for ACELP in USAC", Organisation Internationale De Normalisation ISO/IEC JTC1/SC29/WG11. MPEG2012/M19305. Coding of Moving Pictures and Audio. Daegu, Korea., Jan. 2011, 13 Pages.

(56) References Cited

OTHER PUBLICATIONS

Wang, F et al., "Frequency Domain Adaptive Postfiltering for Enhancement of Noisy Speech", Speech Communication 12. Elsevier Science Publishers. Amsterdam, North-Holland. vol. 12, No. 1., Mar. 1993, 41-56.
Waterschoot, T et al., "Comparison of Linear Prediction Models for Audio Signals", EURASIP Journal on Audio, Speech, and Music Processing. vol. 24., Dec. 2008, 27 pages.
Zernicki, T et al., "Report on CE on Improved Tonal Component Coding in eSBR", International Organisation for Standardisation Organisation Internationale De Normalisation ISO/IEC JTC1/SC29/WG11. Coding of Moving Pictures and Audio. Daegu, South Korea, Jan. 2011, 20 Pages.
3GPP, TS 26.290 Version 9.0.0; Digital cellular telecommunications system (Phase 2+); Universal Mobile Telecommunications System (UMTS); LTE; Audio codec processing functions; Extended Adaptive Multi-Rate-Wideband (AMR-WB+) codec; Transcoding functions (3GPP TS 26.290 version 9.0.0 release 9), Jan. 2010, Chapter 5.3, pp. 24-39.
Britanak, et al., "A new fast algorithm for the unified forward and inverse MDCT/MDST computation", Signal Processing, vol. 82, Mar. 2002, pp. 433-459.
A Silence Compression Scheme for G.729 Optimized for Terminals Conforming to Recommendation V.70, ITU-T Recommendation G.729—Annex B, International Telecommunication Union, Nov. 1996, pp. 1-16.
Martin, R., Spectral Subtraction Based on Minimum Statistics, Proceedings of European Signal Processing Conference (EUSIPCO), Edinburg, Scotland, Great Britain, Sep. 1994, pp. 1182-1185.
Herley, C. et al., "Tilings of the Time-Frequency Plane: Construction of Arbitrary Orthogonal Bases and Fast Tilings Algorithms", IEEE Transactions on Signal Processing , vol. 41, No. 12, Dec. 1993, pp. 3341-3359.
Lefebvre, R. et al., "High quality coding of wideband audio signals using transform coded excitation (TCX)", 1994 IEEE International Conference on Acoustics, Speech, and Signal Processing, Apr. 19-22, 1994, pp. I/193 to I/196 (4 pages).
Fuchs, et al., "MDCT-Based Coder for Highly Adaptive Speech and Audio Coding", 17th European Signal Processing Conference (EUSIPCO 2009), Glasgow, Scotland Aug. 24-28, 2009, pp. 1264 - 1268.
Song, et al., "Research on Open Source Encoding Technology for MPEG Unified Speech and Audio Coding", Journal of the Institute of Electronics Engineers of Korea vol. 50 No. 1, Jan. 2013, pp. 86-96.

* cited by examiner

| subband no. | weighting coeff. |
|---|---|
| 1 | 1 |
| ⋮ | ⋮ |
| 6 | 1 |
| 7 | 0.8 |
| 8 | 0.6 |
| 9 | 0.4 |
| 10 | 0.2 |
| 11 | 0 |
| 12 | 0 |
| 13 | 0 |
| 14 | 0 |

impulse response and frequency response
of the low pass filter in AMR-WB+ impulse response and frequency response
in the QMF domain

```
W [32] = { 1.000040f, 0.917218f, 0.702561f, 0.438018f, 0.208838f, 0.063451f, 0.001553f,
           0.008564f, 0.001777f, 0.002472f, 0.001370f, 0.000718f,
           0.000926f, 0.000060f, 0.000554f, 0.000182f, 0.000270f, 0.000229f, 0.000080f, 0.000191f,
           0.000030f, 0.000122f, 0.000082f, 0.000045f, 0.000081f,
           0.000010f, 0.000052f, 0.000035f, 0.000017f, 0.000037f, 0.000016f, 0.000015f };
```

weights for 32 QMF subbands

FIG 5 frequency response for 16 QMF bands

W [16] = { 1.000040f, 0.702561f, 0.208838f, 0.001553f, 0.001777f, 0.001370f, 0.000926f, 0.000554f, 0.000270f, 0.000080f, 0.000030f, 0.000082f, 0.000081f, 0.000052f, 0.000017f, 0.000016f };

weights for 16 QMF bands block diagram of the low frequency pitch enhancer implemented post-processing configuration $$H_E(z) = (1-\alpha) + \frac{\alpha}{2} z^{T} + \frac{\alpha}{2} z^{-T}$$

$$s_{LE}(n) = (1-\alpha)\hat{s}(n) + \frac{\alpha}{2}\hat{s}(n-T) + \frac{\alpha}{2}\hat{s}(n+T)$$

$$\begin{aligned}
s_E(n) &= \hat{s}(n) * h_{HP}(n) + s_{LE}(n) * h_{LP}(n) \\
&= \hat{s}(n) * h_{HP}(n) + \left((1-\alpha)\hat{s}(n) + \frac{\alpha}{2} s(n-T) + \frac{\alpha}{2}\hat{s}(n+T)\right) * h_{LP}(n) \\
&= \hat{s}(n) * h_{HP}(n) + \hat{s}(n) * h_{LP}(n) - \left(\alpha\hat{s}(n) - \frac{\alpha}{2}\hat{s}(n-T) - \frac{\alpha}{2}\hat{s}(n+T)\right) * h_{LP}(n) \\
&= \hat{s}(n) - \alpha\left(\hat{s}(n) - \frac{1}{2}\hat{s}(n-T) - \frac{1}{2}\hat{s}(n+T)\right) * h_{LP}(n) \\
&= \hat{s}(n) - \alpha\, e_{LT}(n) * h_{LP}(n)
\end{aligned}$$

$$P_{LT}(z) = 1 - 0.5\, z^{T} - 0.5\, z^{-T}$$

FIG 9
(PRIOR ART)

low delay implementation of
long term prediction filter:

$\hat{s}(n+T)$ is replaced by $\hat{s}$ $$\begin{aligned}
s_E(n) &= \hat{s}(n) - \alpha[\hat{s}(n) - \frac{1}{2}\hat{s}(n-T) - \frac{1}{2}\hat{s}(n)] \\
&= \hat{s}(n) - \frac{\alpha}{2}[\hat{s}(n) - \hat{s}(n-T)]
\end{aligned}$$

$$P_{LT}(z) = 0.5 - 0.5\, z^{T}$$

FIG 10

APPARATUS AND METHOD FOR PROCESSING A DECODED AUDIO SIGNAL IN A SPECTRAL DOMAIN

CROSS-REFERENCE TO RELATED APPLICATIONS

This application is a continuation of copending International Application No. PCT/EP2012/052292, filed Feb. 10, 2012, which is incorporated herein by reference in its entirety, and additionally claims priority from U.S. Application No. 61/442,632, filed Feb. 14, 2011, which is also incorporated herein by reference in its entirety.

BACKGROUND OF THE INVENTION

The present invention relates to audio processing and, in particular, to the processing of a decoded audio signal for the purpose of quality enhancement.

Recently, further developments regarding switched audio codecs have been achieved. A high quality and low bit rate switched audio codec is the unified speech and audio coding concept (USAC concept). There is a common pre/post-processing consisting of an MPEG surround (MPEGs) functional unit to handle a stereo or multichannel processing and an enhanced SBR (eSBR) unit which handles the parametric representation of the higher audio frequencies in the input signal. Subsequently there are two branches, one consisting of an advanced audio coding (AAC) tool path and the other consisting of a linear prediction coding (LP or LPC domain) based path which, in turn, features either a frequency domain representation or a time domain representation of the LPC residual. All transmitted spectra for both AAC and LPC are represented in the MDCT domain following quantization and arithmetic coding. The time domain representation uses an ACELP excitation coding scheme. Block diagrams of the encoder and the decoder are given in FIG. 1.1 and FIG. 1.2 of ISO/IEC CD 23003-3.

An additional example for a switched audio codec is the extended adaptive multi-rate-wide band (AMR-WB+) codec as described in 3GPP TS 26.290 V10.0.0 (2011-3). The AMR-WB+ audio codec processes input frames equal to 2048 samples at an internal sampling frequency $F_s$. The internal sampling frequencies are limited to the range 12800 to 38400 Hz. The 2048-sample frames are split into two critically sampled equal frequency bands. This results in two super frames of 1024 samples corresponding to the low frequency (LF) and high frequency (HF) band. Each super frame is divided into four 256-sample frames. Sampling at the internal sampling rate is obtained by using a variable sampling conversion scheme which re-samples the input signal. The LF and HF signals are then encoded using two different approaches: the LF is encoded and decoded using a "core" encoder/decoder, based on switched ACELP and transform coded excitation (TCX). In the ACELP mode, the standard AMR-WB codec is used. The HF signal is encoded with relatively few bits (16 bits per frame) using a bandwidth extension (BWE) method. The AMR-WB coder includes a pre-processing functionality, an LPC analysis, an open loop search functionality, an adaptive codebook search functionality, an innovative codebook search functionality and memories update. The ACELP decoder comprises several functionalities such as decoding the adaptive codebook, decoding gains, decoding the innovative codebook, decode ISP, a long term prediction filter (LTP filter), the construct excitation functionality, an interpolation of ISP for four sub-frames, a post-processing, a synthesis filter, a de-emphasis and an up-sampling block in order to finally obtain the lower band portion of the speech output. The higher band portion of the speech output is generated by gains scaling using an HB gain index, a VAD flag, and a 16 kHz random excitation. Furthermore, an HB synthesis filter is used followed by a band pass filter. More details are in FIG. 3 of G.722.2.

This scheme has been enhanced in the AMR-WB+ by performing a post-processing of the mono low-band signal. Reference is made to FIGS. 7, 8 and 9 illustrating the functionality in AMR-WB+. FIG. 7 illustrates pitch enhancer 700, a low pass filter 702, a high pass filter 704, a pitch tracking stage 706 and an adder 708. The blocks are connected as illustrated in FIG. 7 and are fed by the decoded signal.

In the low-frequency pitch enhancement, two-band decomposition is used and adaptive filtering is applied only to the lower band. This results in a total post-processing that is mostly targeted at frequencies near the first harmonics of the synthesize speech signal. FIG. 7 shows the block diagram of the two-band pitch enhancer. In the higher branch the decoded signal is filtered by the high pass filter 704 to produce the higher band signals $s_H$. In the lower branch, the decoded signal is first processed through the adaptive pitch enhancer 700 and then filtered through the low pass filter 702 to obtain the lower band post-process signal ($s_{LEE}$). The post-process decoded signal is obtained by adding the lower band post-process signal and the higher band signal. The object of the pitch enhancer is to reduce the inter-harmonic noise in the decoded signal which is achieved by a time-varying linear filter with a transfer function $H_E$ indicated in the first line of FIG. 9 and described by the equation in the second line of FIG. 9. $\alpha$ is a coefficient that controls the inter-harmonic attenuation. T is the pitch period of the input signal $\hat{S}$ (n) and $s_{LE}$ (n) is the output signal of the pitch enhancer. Parameters T and $\alpha$ vary with time and are given by the pitch tracking module 706 with a value of $\alpha$=1, the gain of the filter described by the equation in the second line of FIG. 9 is exactly zero at frequencies 1/(2T), 3/(2T), 5/(2T), etc, i.e., at the mid-point between the DC (0 Hz) and the harmonic frequencies 1/T, 3/T, 5/T, etc. When $\alpha$ approaches zero, the attenuation between the harmonics produced by the filter as defined in the second line of FIG. 9 decreases. When $\alpha$ is zero, the filter has no effect and is an all-pass. To confine the post-processing to the low frequency region, the enhanced signal $s_{LE}$ is low pass filtered to produce the signal $s_{LEF}$ which is added to the high pass filter signal $s_H$ to obtain the post-process synthesis signal $s_E$.

Another configuration equivalent to the illustration in FIG. 7 is illustrated in FIG. 8 and the configuration in FIG. 8 eliminates the need to high pass filtering. This is explained with respect to the third equation for $s_E$ in FIG. 9. The $h_{LP}$(n) is the impulse response of the low pass filter and $h_{HP}$(n) is the impulse response of the complementary high pass filter. Then, the post-process signal $s_{E(n)}$ is given by the third equation in FIG. 9. Thus, the post processing is equivalent to subtracting the scaled low pass filtered long-term error signal $\alpha.e_{LT}$(n) from the synthesis signal $\hat{s}$ (n). The transfer function of the long-term prediction filter is given as indicated in the last line of FIG. 9. This alternative post-processing configuration is illustrated in FIG. 8. The value T is given by the received closed-loop pitch lag in each subframe (the fractional pitch lag rounded to the nearest integer). A simple tracking for checking pitch doubling is performed. If the normalized pitch correlation at delay T/2 is larger than 0.95 then the value T/2 is used as the new pitch lag for post-processing. The factor $\alpha$ is given by $\alpha$=0.5 $g_p$, constrained to a greater than or equal to zero and lower than or equal to 0.5. $g_p$ is the decoded pitch gain bounded between 0 and 1. In TCX mode, the value of $\alpha$ is set to zero. A linear phase FIR low pass filter with 25 coefficients is used with the cut-off frequency of about 500 Hz. The filter delay is 12 samples). The upper branch needs to introduce a delay corresponding to the delay of the processing in the lower branch in order to keep the signals in the two branches time aligned before performing the subtraction. In AMR-WB+ Fs=2× sampling rate of the core. The core sampling rate is equal to 12800 Hz. So the cut-off frequency is equal to 500 Hz.

It has been found that, particularly for low delay applications, the filter delay of 12 samples introduced by the linear phase FIR low pass filter contributes to the overall delay of the encoding/decoding scheme. There are other sources of systematic delays at other places in the encoding/decoding chain, and the FIR filter delay accumulates with the other sources.

SUMMARY

According to an embodiment, an apparatus for processing a decoded audio signal may have: a filter for filtering the decoded audio signal to obtain a filtered audio signal; a time-spectral converter stage for converting the decoded audio signal and the filtered audio signal into corresponding spectral representations, each spectral representation having a plurality of subband signals; a weighter for performing a frequency selective weighting of the spectral representation of the filtered audio signal by multiplying subband signals by respective weighting coefficients to obtain a weighted filtered audio signal; a subtractor for performing a subband-wise subtraction between the weighted filtered audio signal and the spectral representation of the audio signal to obtain a result audio signal; and a spectral-time converter for converting the result audio signal or a signal derived from the result audio signal into a time domain representation to obtain a processed decoded audio signal.

According to an embodiment, a method of processing a decoded audio signal may have the steps of: filtering the decoded audio signal to obtain a filtered audio signal; converting the decoded audio signal and the filtered audio signal into corresponding spectral representations, each spectral representation having a plurality of subband signals; performing a frequency selective weighting of the filtered audio signal by multiplying subband signals by respective weighting coefficients to obtain a weighted filtered audio signal; performing a subband-wise subtraction between the weighted filtered audio signal and the spectral representation of the audio signal to obtain a result audio signal; and converting the result audio signal or a signal derived from the result audio signal into a time domain representation to obtain a processed decoded audio signal.

Another embodiment may have a computer program having a program code for performing, when running on a computer, the inventive method of processing a decoded audio signal.

The present invention is based on the finding that the contribution of the low pass filter in the bass post filtering of the decoded signal to the overall delay is problematic and has to be reduced. To this end, the filtered audio signal is not low pass filtered in the time domain but is low pass filtered in the spectral domain such as a QMF domain or any other spectral domain, for example, an MDCT domain, an FFT domain, etc. It has been found that the transform from the spectral domain into the frequency domain and, for example, into a low resolution frequency domain such as a QMF domain can be performed with low delay and the frequency-selectivity of the filter to be implemented in the spectral domain can be implemented by just weighting individual subband signals from the frequency domain representation of the filtered audio signal. This "impression" of the frequency-selected characteristic is, therefore, performed without any systematic delay since a multiplying or weighting operation with a subband signal does not incur any delay. The subtraction of the filtered audio signal and the original audio signal is performed in the spectral domain as well. Furthermore, it is preferred to perform additional operations which are, for example, necessary anyway, such as a spectral band replication decoding or a stereo or a multichannel decoding are additionally performed in one and the same QMF domain. A frequency-time conversion is performed only at the end of the decoding chain in order to bring the finally produced audio signal back into the time domain. Hence, depending on the application, the result audio signal generated by the subtractor can be converted back into the time domain as it is when no additional processing operations in the QMF domain are required anymore. However, when the decoding algorithm has additional processing operations in the QMF domain, then the frequency-time converter is not connected to the subtractor output but is connected to the output of the last frequency domain processing device.

Preferably, the filter for filtering the decoded audio signal is a long term prediction filter. Furthermore, it is preferred that the spectral representation is a QMF representation and it is additionally preferred that the frequency-selectivity is a low pass characteristic.

However, any other filters different from a long term prediction filter, any other spectral representations different from a QMF representation or any other frequency-selectivity different from a low pass characteristic can be used in order to obtain a low-delay post-processing of a decoded audio signal.

BRIEF DESCRIPTION OF THE DRAWINGS

Embodiments of the present invention will be detailed subsequently referring to the appended drawings, in which:

FIG. 5 illustrates weighting factors for the weighters for the example of 32 QMF subbands;

FIG. 9 illustrates a derivation of the implementation of FIG. 8; and

FIG. 10 illustrates a low delay implementation of the long term prediction filter in accordance with an embodiment.

DETAILED DESCRIPTION OF THE INVENTION

Figure 1A:
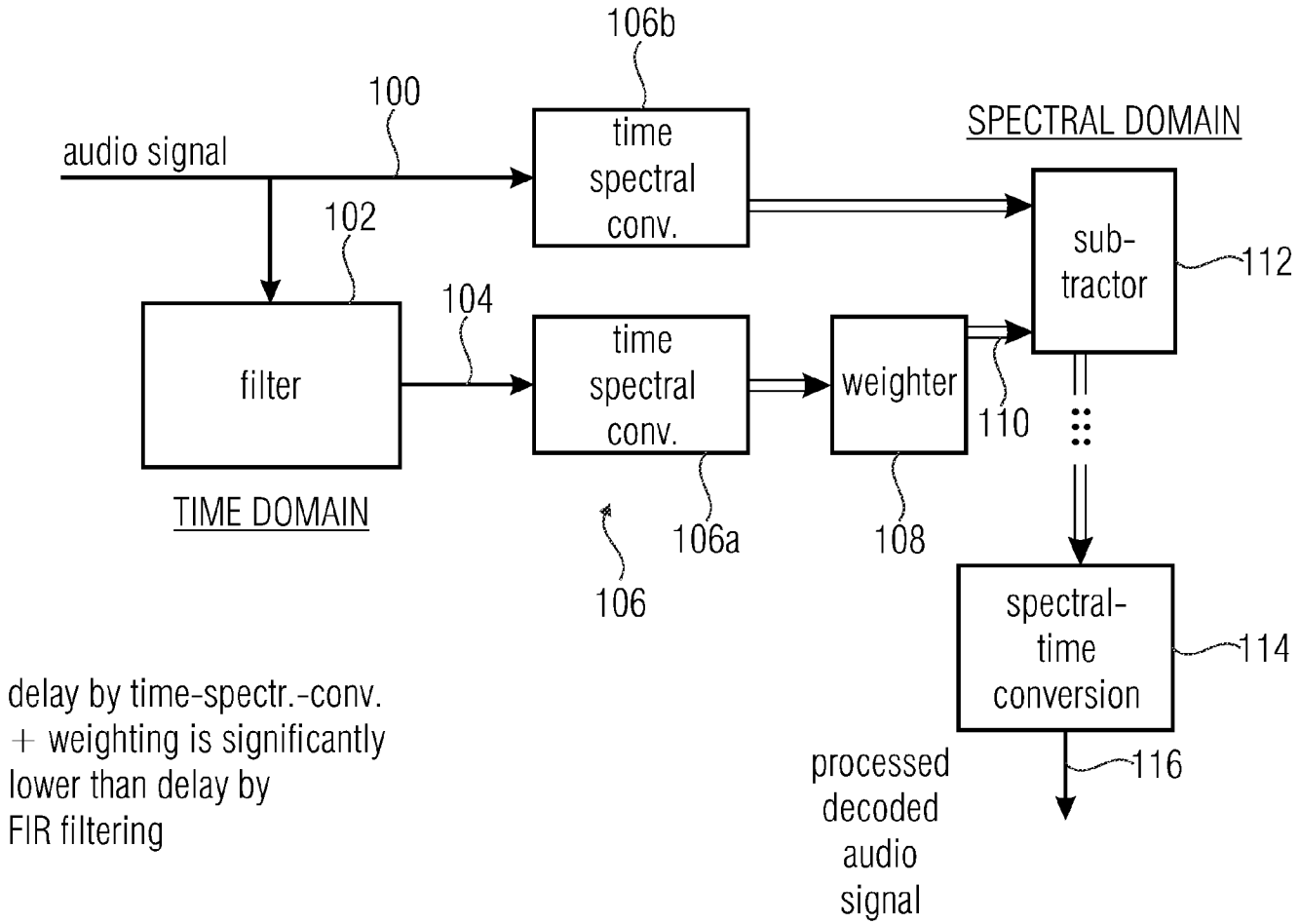
FIG. 1*a* is a block diagram of an apparatus for processing a decoded audio signal in accordance with an embodiment.

FIG. 1*a* illustrates an apparatus for processing a decoded audio signal on line 100. The decoded audio signal on line 100 is input into the filter 102 for filtering the decoded audio signal to obtain a filtered audio signal on line 104. The filter 102 is connected to a time-spectral converter stage 106 illustrated as two individual time-spectral converters 106*a* for the filtered audio signal and 106*b* for the decoded audio signal on line 100. The time-spectral converter stage is configured for converting the audio signal and the filtered audio signal into a corresponding spectral representation each having a plurality of subband signals. This is indicated by double lines in FIG. 1*a*, which indicates that the output of blocks 106*a*, 106*b* comprises a plurality of individual subband signals rather than a single signal as illustrated for the input into blocks 106*a*, 106*b*.

The apparatus for processing additionally comprises a weighter 108 for performing a frequency-selective weighting of the filtered audio signal output by block 106*a* by multiplying individual subband signals by respective weighting coefficients to obtain a weighted filtered audio signal on line 110.

Furthermore, a subtractor 112 is provided. The subtractor is configured for performing a subband-wise subtraction between the weighted filtered audio signal and the spectral representation of the audio signal generated by block 106*b*.

Furthermore, a spectral-time converter 114 is provided. The spectral-time conversion performed by block 114 is so that the result audio signal generated by the subtractor 112 or a signal derived from the result audio signal is converted into a time domain representation to obtain the processed decoded audio signal on line 116.

Although FIG. 1*a* indicates that the delay by time-spectral conversion and weighting is significantly lower than delay by FIR filtering, this is not necessary in all circumstances, since in situations, in which the QMF is absolutely necessary cumulating the delays of FIR filtering and of QMF is avoided. Hence, the present invention is also useful, when the delay by time-spectral conversion weighting is even higher than the delay of an FIR filter for bass post filtering.

Figure 1B:
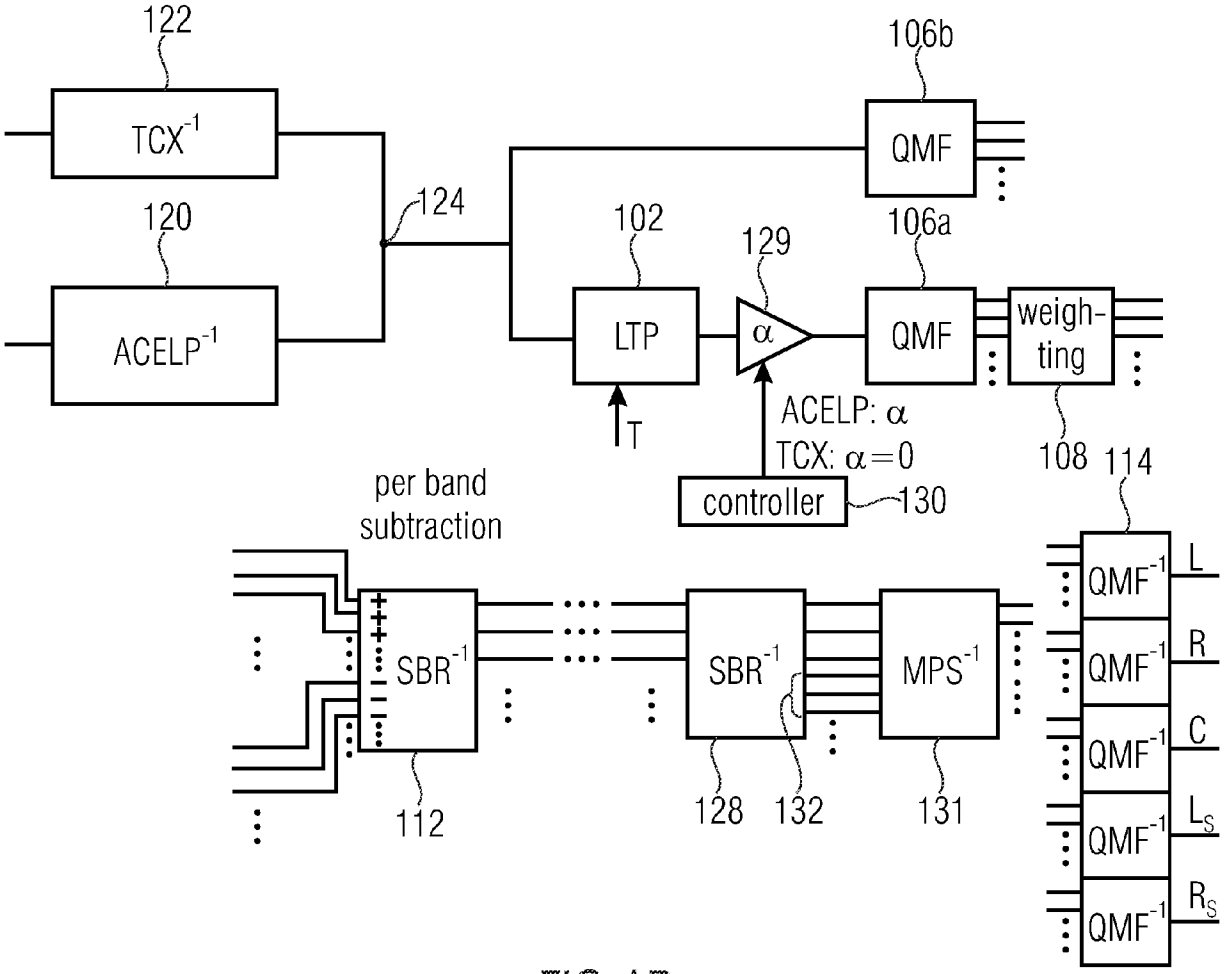
FIG. 1*b* is a block diagram of a preferred embodiment for the apparatus for processing a decoded audio signal.

FIG. 1*b* illustrates a preferred embodiment of the present invention in the context of the USAC decoder or the AMR-WB+ decoder. The apparatus illustrated in FIG. 1*b* comprises an ACELP decoder stage 120, a TCX decoder stage 122 and a connection point 124 where the outputs of the decoders 120, 122 are connected. Connection point 124 starts two individual branches. The first branch comprises the filter 102 which is, preferably, configured as a long term prediction filter which is set by the pitch lag T followed by an amplifier 129 of an adaptive gain α. Furthermore, the first branch comprises the time-spectral converter 106*a* which is preferably implemented as a QMF analysis filterbank. Furthermore, the first branch comprises the weighter 108 which is configured for weighting the subband signals generated by the QMF analysis filterbank 106*a*.

In the second branch, the decoded audio signal is converted into the spectral domain by the QMF analysis filterbank 106*b*.

Although the individual QMF blocks 106*a*, 106*b* are illustrated as two separate elements, it is noted that, for analyzing the filtered audio signal and the audio signal, it is not necessarily required to have two individual QMF analysis filterbanks. Instead, a single QMF analysis filterbank and a memory may be sufficient, when the signals are transformed one after the other. However, for very low delay implementations, it is preferred to use individual QMF analysis filterbanks for each signal so that the single QMF block does not form the bottleneck of the algorithm.

Preferably, the conversion into the spectral domain and back into the time domain is performed by an algorithm, having a delay for the forward and backward transform being smaller than the delay of the filtering in the time domain with the frequency selective characteristic. Hence, the transforms should have an overall delay being smaller than the delay of the filter in question. Particularly useful are low resolution transforms such as QMF-based transforms, since the low frequency resolution results in the need for a small transform window, i.e., in a reduced systematic delay. Preferred applications only require a low resolution transform decomposing the signal in less than 40 subbands, such as 32 or only 16 subbands. However, even in applications where the time-spectral conversion and weighting introduce a higher delay than the low pass filter, an advantage is obtained due to the fact that a cumulating of delays for the low pass filter and the time-spectral conversion necessary anyway for other procedures is avoided.

For applications, however, which anyway require a time frequency conversion due to other processing operations, such as resampling, SBR or MPS, a delay reduction is obtained irrespective of the delay incurred by the time-frequency or frequency-time conversion, since the "inclusion" of the filter implementation into the spectral domain, the time domain filter delay is completely saved due to the fact that the subband-wise weighting is performed without any systematic delay.

The adaptive amplifier 129 is controlled by a controller 130. The controller 130 is configured for setting the gain α of amplifier 129 to zero, when the input signal is a TCX-decoded signal. Typically, in switched audio codecs such as USAC or AMR-WB+, the decoded signal at connection point 124 is typically either from the TCX-decoder 122 or from the ACELP-decoder 120. Hence, there is a time-multiplex of decoded output signals of the two decoders 120, 122. The controller 130 is configured for determining for a current time instant, whether the output signal is from a TCX-decoded signal or an ACELP-decoded signal. When it is determined that there is a TCX signal, then the adaptive gain α is set to zero so that the first branch consisting of elements 102, 129, 106*a*, 108 does not have any significance. This is due to the fact that the specific kind of post filtering used in AMR-WB+ or USAC is only required for the ACELP-coded signal. However, when other post filtering implementations apart from harmonic filtering or pitch enhancing is performed, then a variable gain α can be set differently depending on the needs.

When, however, the controller 130 determines that the currently available signal is an ACELP-decoded signal, then the value of amplifier 129 is set to the right value for α which typically is between 0 and 0.5. In this case, the first branch is significant and the output signal of the subtractor 112 is substantially different from the originally decoded audio signal at connection point 124.

The pitch information (pitch lag and gain alpha) used in filter 120 and amplifier 128 can come from the decoder and/or a dedicated pitch tracker. Preferably, the information are coming from the decoder and then re-processed (refined) through a dedicated pitch tracker/long term prediction analysis of the decoded signal.

The result audio signal generated by subtractor 112 performing the per band or per subband subjection is not immediately performed back into the time domain. Instead, the signal is forwarded to an SBR decoder module 128. Module 128 is connected to a mono-stereo or mono-multichannel decoder such as an MPS decoder 131, where MPS stands for MPEG surround.

Typically, the number of bands is enhanced by the spectral bandwidth replication decoder which is indicated by the three additional lines 132 at the output of block 128.

Furthermore, the number of outputs is additionally enhanced by block 131. Block 131 generates, from the mono-signal at the output of block 129 *a*, for example, 5-channel signal or any other signal having two or more channels. Exemplarily, a 5-channel scenario have a left channel L, a right channel R, a center channel C, a left surround channel $L_S$ and a right surround channel $R_s$ is illustrated. The spectral-time converter 114 exists, therefore, for each of the individual channels, i.e., exists five times in FIG. 1*b* in order to convert each individual channel signal from the spectral domain which is, in the FIG. 1*b* example, the QMF domain, back into the time domain at the output of block 114. Again, there is not necessarily a plurality of individual spectral-time converters. There can be a single one as well which processes the conversions one after the other. However, when a very low delay implementation is required, it is preferred to use an individual spectral time converter for each channel.

The present invention is advantageous in that the delay introduced by the bass post filter and, specifically, by the implementation of the low pass filter FIR filter is reduced. Hence, any kind of frequency-selective filtering does not introduce an additional delay with respect to the delay required for the QMF or, stated generally, the time/frequency transform.

The present invention is particularly advantageous, when a QMF or, generally, a time-frequency transform is required anyway as, for example, in the case of FIG. 1*b*, where the SBR functionality and the MPS functionality are performed in the spectral domain anyway. An alternative implementation, where a QMF is required is, when a resampling is performed with the decoded signal, and when, for the purpose of resampling, a QMF analysis filterbank and a QMF synthesis filterbank with a different number of filterbank channels is required.

Furthermore, a constant framing between ACELP and TCX is maintained due to the fact that both signals, i.e., TCX and ACELP now have the same delay.

The functionality of a bandwidth extension decoder 129 is described in detail in section 6.5 of ISO/IEC CD 23003-3. The functionality of the multichannel decoder 131 is described in detail, for example, in section 6.11 of ISO/IEC CD 23003-3. The functionalities behind the TCX decoder and ACELP decoder are described in detail in blocks 6.12 to 6.17 of ISO/IEC CD 23003-3.

Figures 2A, 2B:
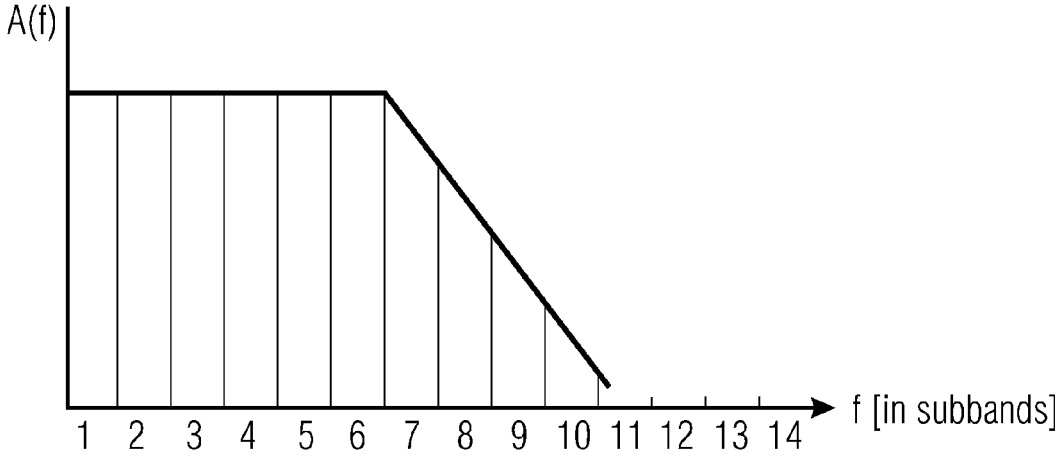
FIG. 2*a* illustrates a frequency-selective characteristic exemplarily as a low pass characteristic.
FIG. 2*b* illustrates weighting coefficients and associated subbands.
Figure 2C:
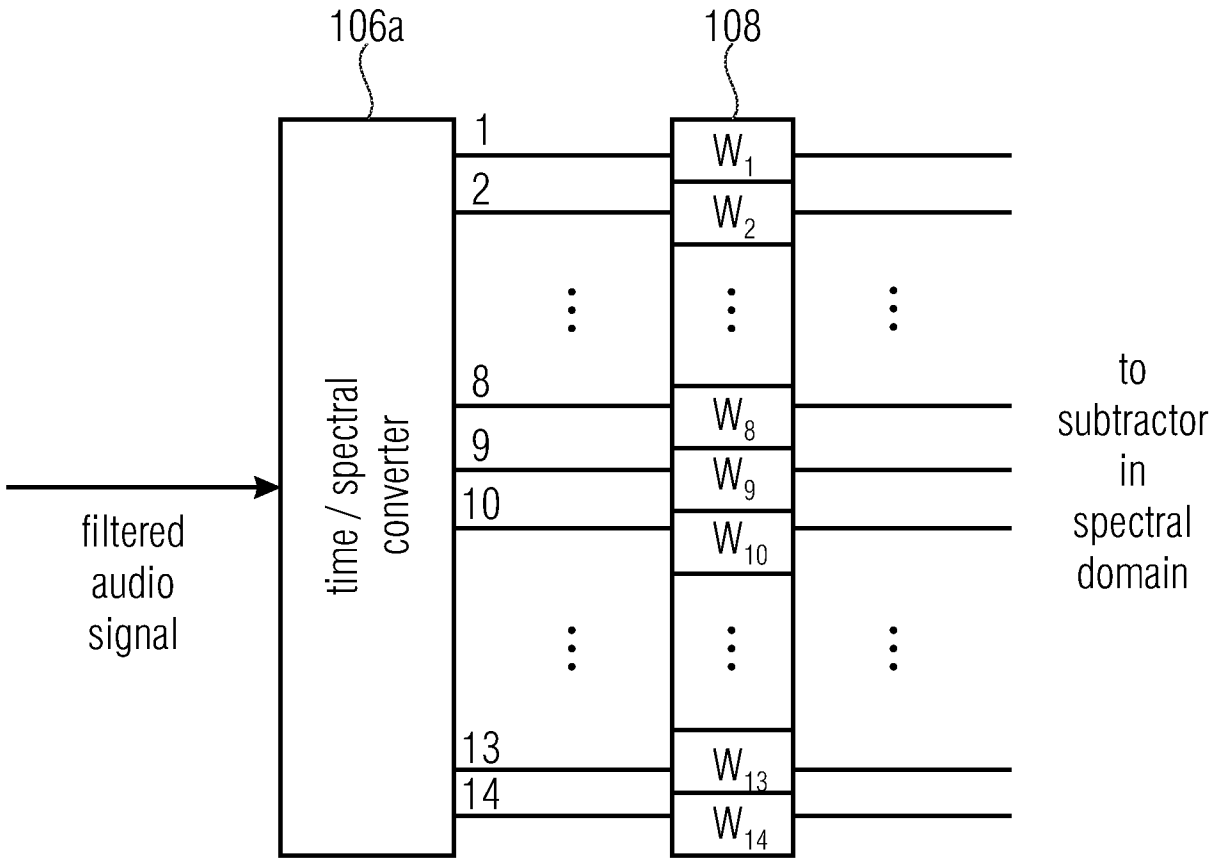
FIG. 2*c* illustrates a cascade of the time/spectral converter and a subsequently connected weighter for applying weighting coefficients to each individual subband signal.

Subsequently, FIGS. 2*a* to 2*c* are discussed in order to illustrate a schematic example. FIG. 2*a* illustrates a frequency-selected frequency response of a schematic low pass filter.

FIG. 2*b* illustrates the weighting indices for the subband numbers or subbands indicated in FIG. 2*a*. In the schematic case of FIG. 2*a*, subbands 1 to 6 have weighting coefficients equal to 1, i.e., no weighting and bands 7 to 10 have decreasing weighting coefficients and bands 11 to 14 have zeros.

A corresponding implementation of a cascade of a time-spectral converter such as 106*a* and the subsequently connector weighter 108 is illustrated in FIG. 2*c*. Each subband 1, 2 . . . , 14 is input into an individual weighting block indicated by $W_1$, $W_2$, . . . , $W_{14}$. The weighter 108 applies the weighting factor of the table of FIG. 2*b* to each individual subband signal by multiplying each sampling of the subband signal by the weighting coefficient. Then, at the output of the weighter, there exist weighted subband signals which are then input into the subtractor 112 of FIG. 1*a* which additionally performs a subtraction in the spectral domain.

Figure 3:
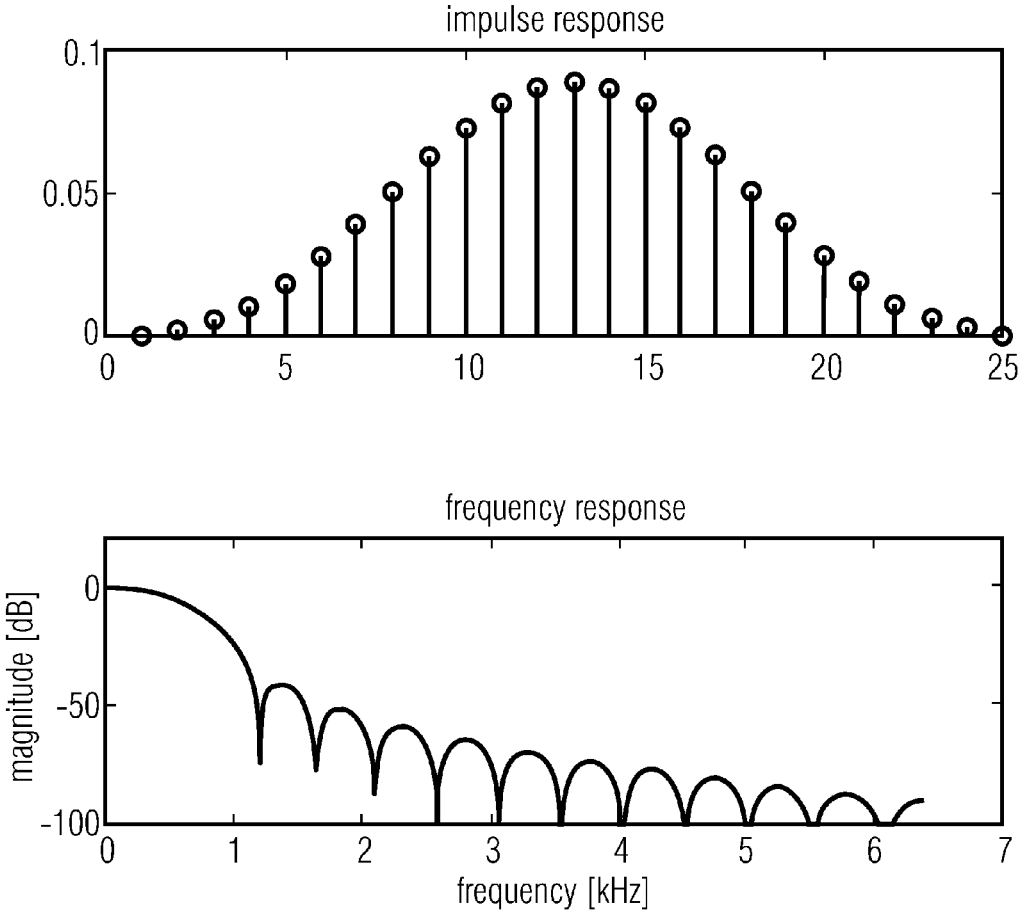
FIG. 3 illustrates an impulse response in the frequency response of the low pass filter in AMR-WB+ illustrated in FIG. 8.
Figure 8:
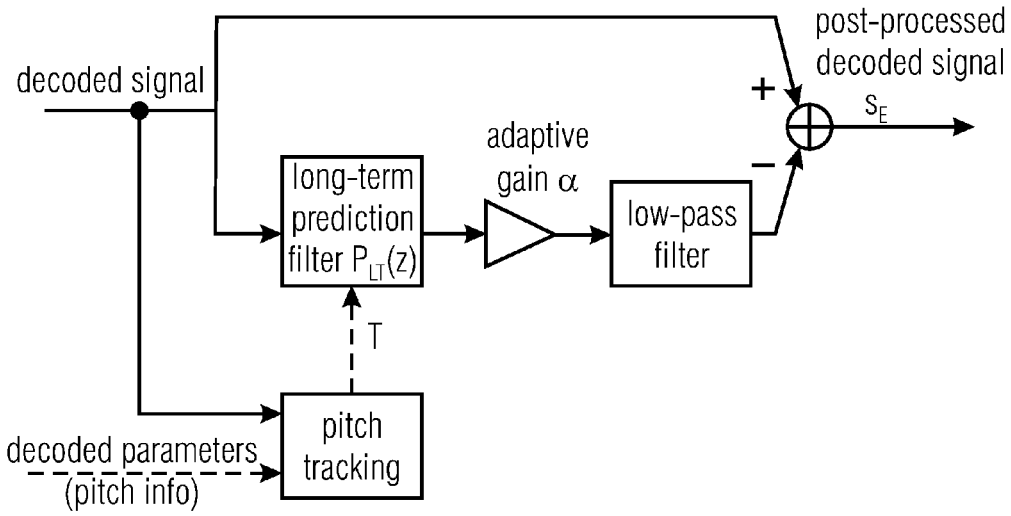
FIG 8 (PRIOR ART)
FIG. 8 illustrates an implemented post-processing configuration of AMR-WB+.

FIG. 3 illustrates the impulse response and the frequency response of the low pass filter in FIG. 8 of the AMR-WB+ encoder. The low pass filter $h_{LP}(n)$ in the time domain is defined in AMR-WB+ by the following coefficients.

a[13]=[0.088250, 0.086410, 0.081074, 0.072768, 0.062294, 0.050623, 0.038774, 0.027692, 0.018130, 0.010578, 0.005221, 0.001946, 0.000385];

$$h_{LP}(n)=a(13-n) \text{ for } n \text{ from 1 to 12}$$

$$h_{LP}(n)=a(n-12) \text{ for } n \text{ from 13 to 25}$$

The impulse response and the frequency response illustrated in FIG. 3 are for a situation, when the filter is applied to a time-domain signal sample that 12.8 kHz. The generated delay is then a delay of 12 samples, i.e., 0.9375 ms.

Figure 4:
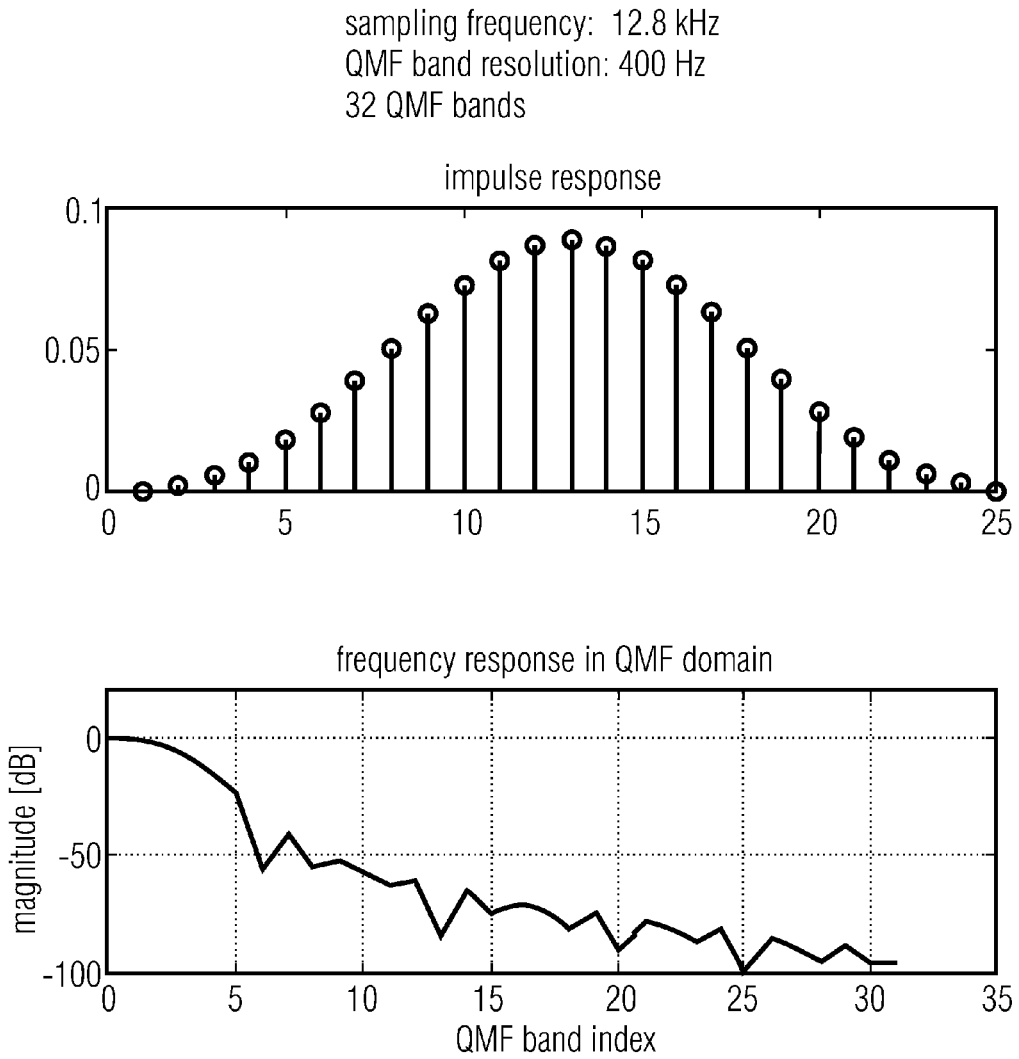
FIG. 4 illustrates an impulse response and the frequency response transformed into the QMF domain.

The filter illustrated in FIG. 3 has a frequency response in the QMF domain, where each QMF has a resolution of 400 Hz. 32 QMF bands cover the bandwidth of the signal sample at 12.8 kHz. The frequency response and the QMF domain are illustrated in FIG. 4.

The amplitude frequency response with a resolution of 400 Hz forms the weights used when applying the low pass filter in the QMF domain. The weights for the weighter 108 are, for the above exemplary parameters as outlined in FIG. 5.

These weights can be calculated as follows:

W=abs(DFT($h_{LP}$(n), 64)), where DFT(x,N) stands for the Discrete Fourier Transform of length N of the signal x. If x is shorter than N, the signal is padded with N-size of x zeros. The length N of the DFT corresponds to two times the number of QMF sub-bands. Since $h_{LP}$(n) is a signal of real coefficients, W shows a Hermitian symmetry and N/2 frequency coefficients between the frequency 0 and the Nyquist frequency.

By analysing the frequency response of the filter coefficients, it corresponds about to a cut-off frequency of 2*pi*10/256. This is used for designing the filter. The coefficients were then quantized for writing them on 14 bits for saving some ROM consumption and in view of a fixed point implementation.

The filtering in QMF domain is then performed as follows:

Y=post-processed signal in QMF domain

X=decoded signal in QMF signal from core-coder

E=inter-harmonic noise generated in TD to remove from X $$Y(k)=X(k)-W(k)\cdot E(k) \text{ for } k \text{ from 1 to 32}$$

Figure 6:
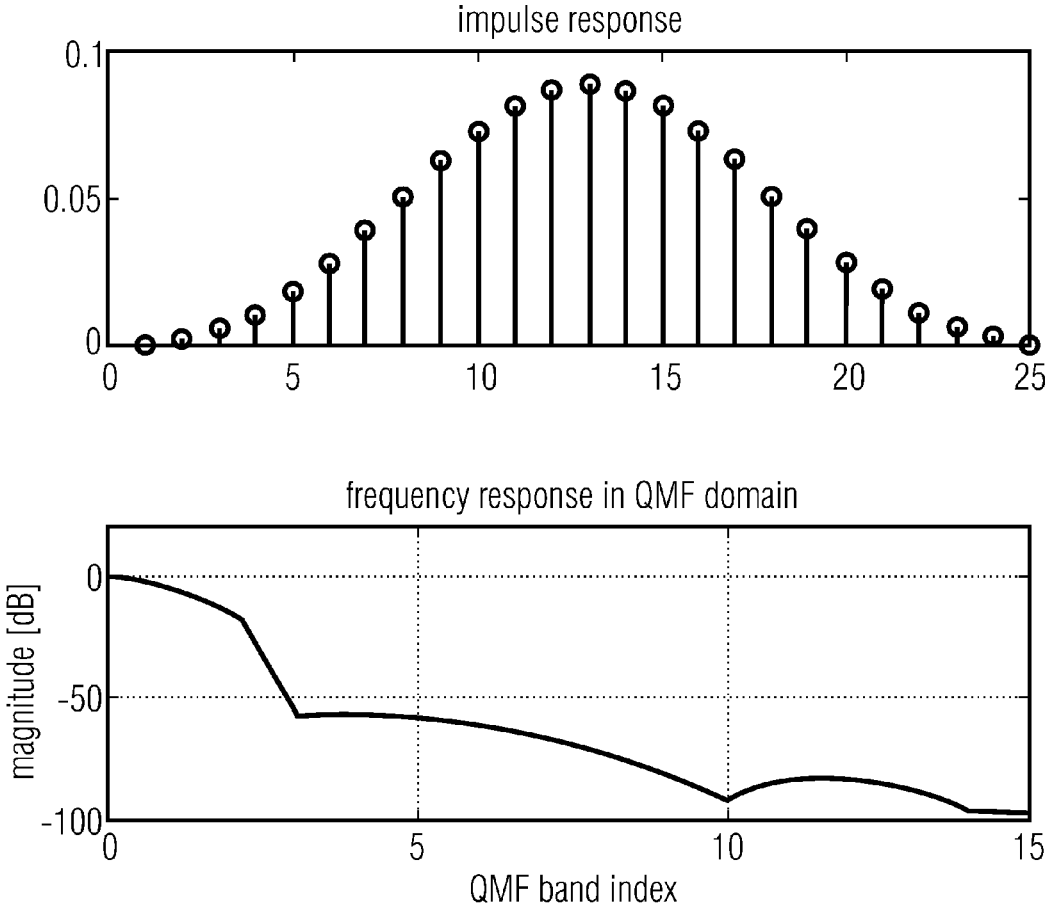
FIG. 6 illustrates the frequency response for 16 QMF bands and the associated 16 weighting factors.
Figure 7:
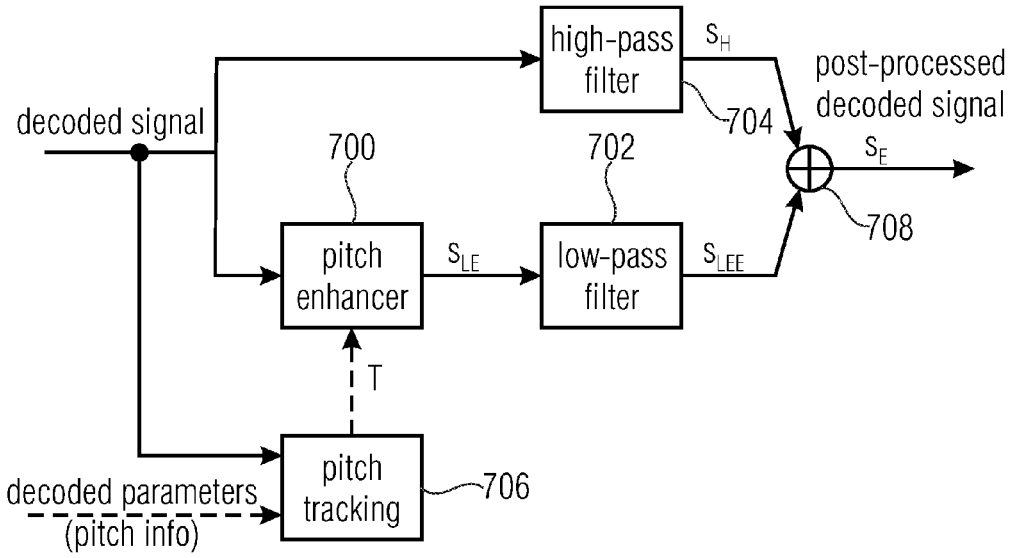
FIG 7 (PRIOR ART)
FIG. 7 illustrates a block diagram of the low frequency pitch enhancer of AMR-WB+.

FIG. 6 illustrates a further example, where the QMF has a resolution of 800 Hz, so that 16 bands cover the full bandwidth of the signal sampled at 12.8 kHz. The coefficients W are then as indicated in FIG. 6 below the plot. The filtering is done in the same way as discussed with respect to FIG. 6, but k only goes from 1 to 16.

The frequency response of the filter in the 16 bands QMF is plotted as illustrated in FIG. 6.

FIG. 10 illustrates a further enhancement of the long term prediction filter illustrated at 102 in FIG. 1*b*.

Particularly, for a low delay implementation, the term $\hat{s}(n+T)$ in the third to last line of FIG. 9 is problematic. This is due to the fact that the T samples are in the future with respect to the actual time n. Therefore, in order to address situations, where, due to the low delay implementation, the future values are not available yet, $\hat{s}(n+T)$ is replaced by $\hat{s}$ as indicated in FIG. 10. Then, the long term prediction filter approximates the long term prediction of the prior art, but with less or zero delay. It has been found that the approximation is good enough and that the gain with respect to the reduced delay is more advantageous than the slight loss in pitch enhancing.

Although some aspects have been described in the context of an apparatus, it is clear that these aspects also represent a description of the corresponding method, where a block or device corresponds to a method step or a feature of a method step. Analogously, aspects described in the context of a method step also represent a description of a corresponding block or item or feature of a corresponding apparatus.

Depending on certain implementation requirements, embodiments of the invention can be implemented in hardware or in software. The implementation can be performed using a digital storage medium, for example a floppy disk a DVD, a CD, a ROM, a PROM, an EPROM, an EEPROM or a FLASH memory, having electronically readable control signals stored thereon, which cooperate (or are capable of cooperating) with a programmable computer system such that the respective method is performed.

Some embodiments according to the invention comprise a non-transitory data carrier having electronically readable control signals, which are capable of cooperating with a programmable computer system, such that one of the methods described herein is performed.

Generally, embodiments of the present invention can be implemented as a computer program product with a program code, the program code being operative for performing one of the methods when the computer program product runs on a computer. The program code may for example be stored on a machine readable carrier.

Other embodiments comprise the computer program for performing one of the methods described herein, stored on a machine readable carrier.

In other words, an embodiment of the inventive method is, therefore, a computer program having a program code for performing one of the methods described herein, when the computer program runs on a computer.

A further embodiment of the inventive methods is, therefore, a data carrier (or a digital storage medium, or a computer-readable medium) comprising, recorded thereon, the computer program for performing one of the methods described herein.

A further embodiment of the inventive method is, therefore, a data stream or a sequence of signals representing the computer program for performing one of the methods described herein. The data stream or the sequence of signals may for example be configured to be transferred via a data communication connection, for example via the Internet.

A further embodiment comprises a processing means, for example a computer, or a programmable logic device, configured to or adapted to perform one of the methods described herein.

A further embodiment comprises a computer having installed thereon the computer program for performing one of the methods described herein.

In some embodiments, a programmable logic device (for example a field programmable gate array) may be used to perform some or all of the functionalities of the methods described herein. In some embodiments, a field programmable gate array may cooperate with a microprocessor in order to perform one of the methods described herein. Generally, the methods are preferably performed by any hardware apparatus.

While this invention has been described in terms of several advantageous embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations, and equivalents as fall within the true spirit and scope of the present invention.

The invention claimed is:

1. Apparatus for processing a decoded audio signal, comprising:

a filter for filtering the decoded audio signal to acquire a filtered audio signal;

a time-spectral converter stage for converting the decoded audio signal and the filtered audio signal into corresponding spectral representations, each spectral representation comprising a plurality of subband signals;

a weighter for performing a frequency selective weighting of the spectral representation of the filtered audio signal by multiplying subband signals by respective weighting coefficients to acquire a weighted filtered audio signal;

a subtractor for performing a subband-wise subtraction between the weighted filtered audio signal and the spectral representation of the decoded audio signal to acquire a result audio signal; and a spectral-time converter for converting the result audio signal or a signal derived from the result audio signal into a time domain representation to acquire a processed decoded audio signal.

2. Apparatus according to claim 1, further comprising a bandwidth enhancement decoder or a mono-stereo or a mono-multichannel decoder to calculate the signal derived from the result audio signal, wherein the spectral-time converter is configured for not converting the result audio signal but the signal derived from the result audio signal into the time domain so that all processing by the bandwidth enhancement decoder or the mono-stereo or mono-multichannel decoder is performed in the same spectral domain as defined by the time-spectral converter stage.

3. Apparatus according to claim 1, wherein the decoded audio signal is an ACELP-decoded output signal, and wherein the filter is a long term prediction filter controlled by pitch information.

4. Apparatus according to claim 1, wherein the weighter is configured for weighting the filtered audio signal so that lower frequency subbands are less attenuated or not attenuated than higher frequency subbands so that the frequency-selective weighting impresses a low pass characteristic to the filtered audio signal.

5. Apparatus according to claim 1, wherein the time-spectral converter stage and the spectral-time converter are configured to implement a QMF analysis filterbank and a QMF synthesis filterbank, respectively.

6. Apparatus according to claim 1, wherein the subtractor is configured for subtracting a subband signal of the weighted filtered audio signal from the corresponding subband signal of the audio signal to acquire a subband of the result audio signal, the subbands belonging to the same filterbank channel.

7. Apparatus according to claim 1, wherein the filter is configured to perform a weighted combination of the decoded audio signal and at least the decoded audio signal shifted in time by a pitch period.

8. Apparatus according to claim 7, wherein the filter is configured for performing the weighted combination by only combining the decoded audio signal and the decoded audio signal existing at earlier time instants.

9. Apparatus according to claim 1, wherein the spectral-time converter comprises a different number of input channels with respect to the time-spectral converter stage so that a sample-rate conversion is acquired, wherein an upsampling is acquired, when the number of input channels into the spectral-time converter is higher than the number of output channels of the time-spectral converter stage and wherein a downsampling is performed, when the number of input channels into the spectral-time converter is smaller than the number of output channels from the time-spectral converter stage.

10. Apparatus according to claim 1, further comprising:

a first decoder for providing the decoded audio signal in a first time portion;

a second decoder for providing a further decoded audio signal in a different second time portion;

a first processing branch connected to the first decoder and the second decoder;

a second processing branch connected to the first decoder and the second decoder, wherein the second processing branch comprises the filter and the weighter and, additionally, comprises a controllable gain stage and a controller, wherein the controller is configured for setting a gain of the gain stage to a first value for the first time portion and to a second value or to zero for the second time portion, which is lower than the first value.

11. Apparatus according to claim 1, further comprising a pitch tracker for providing a pitch lag and for setting the filter based on the pitch lag as the pitch information.

12. Apparatus according to claim 10, wherein the first decoder is configured for providing the pitch information or a part of the pitch information for setting the filter.

13. Apparatus according to claim 10, wherein an output of the first processing branch and an output of the second processing branch are connected to inputs of the subtractor.

14. Apparatus according to claim 1, wherein the decoded audio signal is provided by an ACELP decoder comprised in the apparatus, and wherein the apparatus further comprises a further decoder implemented as a TCX decoder.

15. Method of processing a decoded audio signal, comprising:

filtering the decoded audio signal to acquire a filtered audio signal;

converting the decoded audio signal and the filtered audio signal into corresponding spectral representations, each spectral representation comprising a plurality of subband signals;

performing a frequency selective weighting of the filtered audio signal by multiplying subband signals by respective weighting coefficients to acquire a weighted filtered audio signal;

performing a subband-wise subtraction between the weighted filtered audio signal and the spectral representation of the decoded audio signal to acquire a result audio signal; and converting the result audio signal or a signal derived from the result audio signal into a time domain representation to acquire a processed decoded audio signal.

16. A non-transitory computer-readable medium comprising a computer program which comprises a program code for performing, when running on a computer, the method of processing a decoded audio signal according to claim 15.

* * * * *